US011591791B2

(12) United States Patent
Genest et al.

(10) Patent No.: US 11,591,791 B2
(45) Date of Patent: Feb. 28, 2023

(54) MASONRY BLOCK SYSTEM

(71) Applicants: Christopher Genest, Sanford, ME (US); Matthew Genest, Sanford, ME (US)

(72) Inventors: Christopher Genest, Sanford, ME (US); Matthew Genest, Sanford, ME (US)

( * ) Notice: Subject to any disclaimer, the term of this patent is extended or adjusted under 35 U.S.C. 154(b) by 0 days.

(21) Appl. No.: 16/465,592

(22) PCT Filed: Nov. 15, 2018

(86) PCT No.: PCT/US2018/061192
§ 371 (c)(1),
(2) Date: May 31, 2019

(87) PCT Pub. No.: WO2019/099609
PCT Pub. Date: May 23, 2019

(65) Prior Publication Data

US 2019/0383005 A1 Dec. 19, 2019

Related U.S. Application Data

(60) Provisional application No. 62/587,528, filed on Nov. 17, 2017.

(51) Int. Cl.
*E04B 2/18* (2006.01)
*E04C 1/00* (2006.01)
*E04B 2/02* (2006.01)

(52) U.S. Cl.
CPC ..... *E04B 2/18* (2013.01); *E04C 1/00* (2013.01); *E04B 2002/0217* (2013.01)

(58) Field of Classification Search
CPC ... E04C 1/00; E04C 1/397; E04B 2/46; E04B 2/52; E04B 2/14; E04B 2002/0289; E04B 2002/0256
See application file for complete search history.

(56) References Cited

U.S. PATENT DOCUMENTS 803,380 A * 10/1905 Wickre ..... E04B 2/42 52/605
1,425,302 A * 8/1922 Weber ..... E04B 2/14 52/284
1,432,068 A * 10/1922 Jones ..... E04B 2/14 52/314
1,584,988 A * 5/1926 McCormick ..... E04B 2/14 52/98
RE16,468 E * 11/1926 Heath ..... E04B 2/14 52/380
1,611,373 A * 12/1926 Reagan ..... E04B 2/14 52/100

(Continued)

FOREIGN PATENT DOCUMENTS

CN 202831291 U 3/2013
EP 3228771 A1 10/2017

(Continued)

*Primary Examiner* — Gisele D Ford

(57) ABSTRACT

A masonry block system that includes a stretcher block and a half block, each block having connector means for interlocking with an adjacent block, the blocks being constructed in a such a manner as to enable quick and easy assembly of a building structure.

8 Claims, 3 Drawing Sheets

(56) References Cited

U.S. PATENT DOCUMENTS 1,633,192 A * 6/1927 Reagan ..... E04B 2/14 52/100
1,633,193 A * 6/1927 Reagan ..... E04B 2/14 52/100
1,649,367 A * 11/1927 Reagan ..... E04B 2/14 52/100
1,652,305 A * 12/1927 Frewen ..... E04B 2/14 52/747.12
2,086,989 A * 7/1937 Raad ..... E04B 2/14 52/100
2,198,399 A * 4/1940 Tefft ..... E04B 2/14 52/415
2,239,930 A * 4/1941 Peebles ..... E04B 2/14 52/100
2,852,934 A * 9/1958 Amundson ..... E04B 2/14 52/405.1
3,247,633 A * 4/1966 Schultz ..... E04B 2/16 52/204.1
3,534,518 A * 10/1970 Zagray ..... F27B 9/26 52/258
4,148,166 A * 4/1979 Toone ..... E04B 2/44 52/270
4,172,344 A * 10/1979 Childress, Jr. ..... E04B 2/02 52/314
4,295,313 A * 10/1981 Rassias ..... E04B 2/52 52/436
4,319,440 A * 3/1982 Rassias ..... E04B 2/52 52/438
4,527,373 A * 7/1985 Cruise ..... B28B 11/042 52/405.1
5,457,926 A * 10/1995 Jensen ..... E04B 2/18 52/309.4
5,678,958 A * 10/1997 Rossi ..... E02D 29/025 405/284
9,863,145 B2 * 1/2018 Genest ..... E04B 2/46
10,487,504 B1 * 11/2019 Nickerson ..... E04C 1/41
2004/0128936 A1 * 7/2004 Gilbert ..... E04B 2/46 52/604
2008/0134616 A1 * 6/2008 Craven ..... E04B 2/18 52/606
2008/0184650 A1 * 8/2008 Fischer ..... B28B 7/0097 52/606
2010/0018150 A1 * 1/2010 Azar ..... E04B 2/46 52/606
2011/0258957 A1 * 10/2011 Virnich ..... E04B 2/42 52/562
2012/0159889 A1 * 6/2012 Dyson ..... E04B 2/46 52/503
2013/0276400 A1 * 10/2013 Genest ..... E04C 1/00 52/600
2014/0260029 A1 * 9/2014 Browning ..... E04C 1/41 52/309.4
2015/0052837 A1 * 2/2015 Gomes ..... E04B 2/22 52/405.3
2016/0090705 A1 * 3/2016 Scherkl ..... E02B 3/14 405/114
2016/0160468 A1 * 6/2016 Rossi ..... E02D 29/0241 405/284
2017/0145690 A1 * 5/2017 Genest ..... E04B 2/46

FOREIGN PATENT DOCUMENTS

JP 3076062 B2 8/2000
KR 10-0384931 B1 5/2003

* cited by examiner

MASONRY BLOCK SYSTEM

BACKGROUND INFORMATION

Field of the Invention

The invention relates to a masonry block system, more particularly, the invention relates to building blocks having cavities for reinforcing steel bars, insulation and utilities that enable strong and durable assembly of walls and building structures.

Discussion of Prior Art

Masonry blocks are frequently used for building walls of residential and commercial structures. In a conventional masonry block wall, the blocks are laid on bond, that is, one block covers one half of two blocks below it, so that the vertical joint formed by adjacent blocks in one row does not align with a vertical joint similarly formed in a previous row. Such blocks typically have one or more chambers to allow for the insertion of utilities, insulation, and reinforcing steel bars. Thick layers or mortar are used to seal the connection between one row of blocks the row of blocks above/beneath it.

In general, multiple masonry workers are needed to move the conventional blocks into the proper position. Once a first row of blocks is laid in position a thick layer of mortar is laid on top of the row and a subsequent row of blocks is placed in position. It is typically a tedious and time consuming process. For example, constructing a simple block shed that is approximately 10 feet in length, 8 feet in width and 8 feet in height generally takes a team of four masonry workers two full days of work to construct.

What is needed, therefore, is a masonry block that has the strength to form a wall of a building while having the space for insulation, reinforcing means, and utilities, while also being constructed in a manner that enables a small number of masonry workers to easily and efficiently assemble a building structure.

BRIEF SUMMARY OF THE INVENTION

The invention is a masonry wall system that uses precision ground blocks having interlocking ends to facilitate relatively quick and easy assembly of a building structure. The wall system includes a stretcher block and a half block, with each block having ends that include a male connector and a female connector such that when two blocks are assembled adjacent to one another on a row, the male connector on the first end mates with the female connector on the second end face of the adjacent block. Another row of blocks may be laid on top of a previously laid row of blocks and secured in place by a conventional masonry adhesive, rather than mortar, because the top surface of the blocks are precision ground such that each block has the same dimensions and therefore the height of each block in a row is the same as each other block.

The outer faces of the blocks, being wall faces, form a web around a plurality of inner chambers. The chambers may be used for items such as insulation, reinforcing steel bars ("rebar"), and the installation of utilities. Conventional rebar may be inserted through the chambers in a vertical orientation, and the upper surface of the web may be cut or ground down to insert rebar in a horizontal orientation after which grout is applied to seal the horizontally placed rebar in a secure position. Assuming the base of the wall is horizontally level the design of the blocks allows for quick assembly of a sturdy and durable building structure. For example, constructing a simple block shed that is approximately 10 feet in length, 8 feet in width and 8 feet in height generally takes only two masonry workers a single day of work to construct.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

Figure 1:
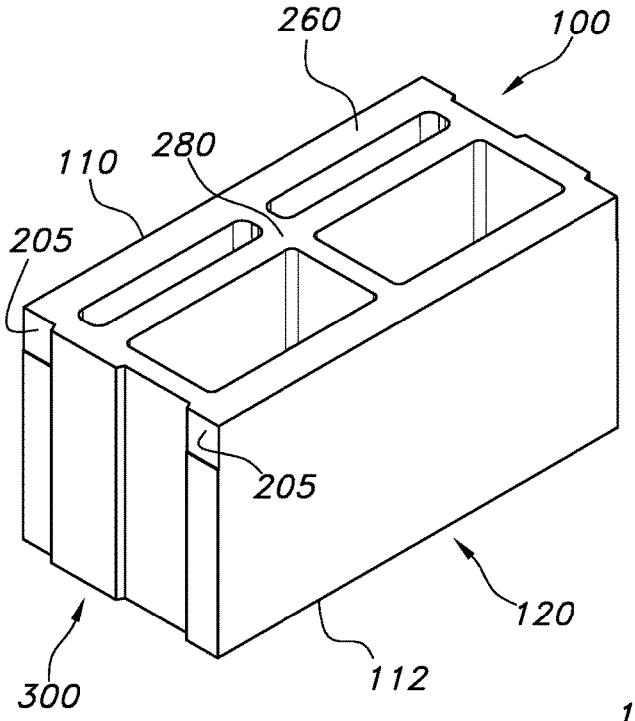
FIG. 1 is a perspective view of a stretcher block according to the invention.
Figure 2:
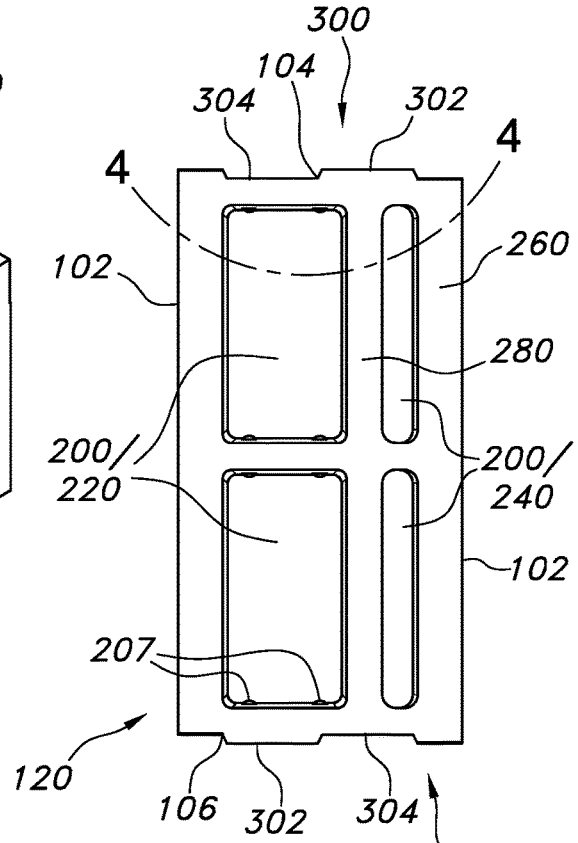
FIG. 2 is a top view of the stretcher block.
Figure 4:
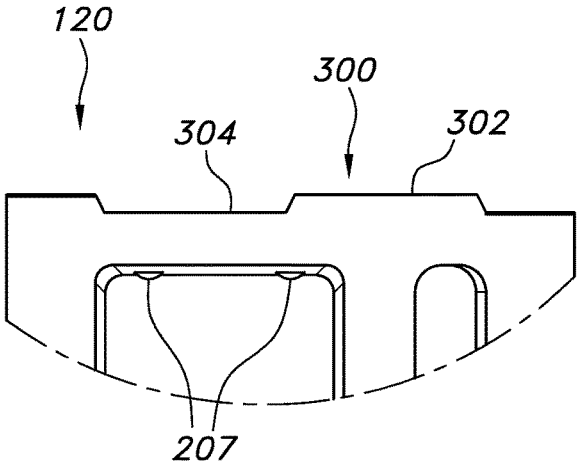
FIG. 4 is an enlarged partial top view of the stretcher block.
Figure 3:
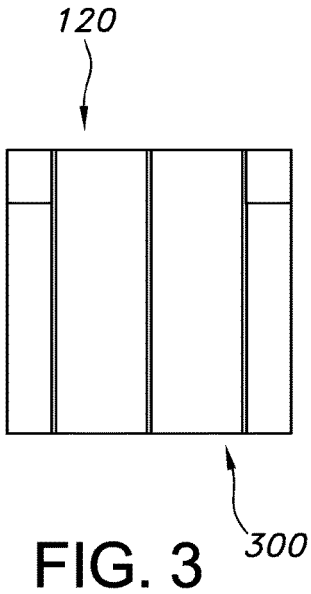
FIG. 3 is a front end view of the stretcher block.
Figure 5:
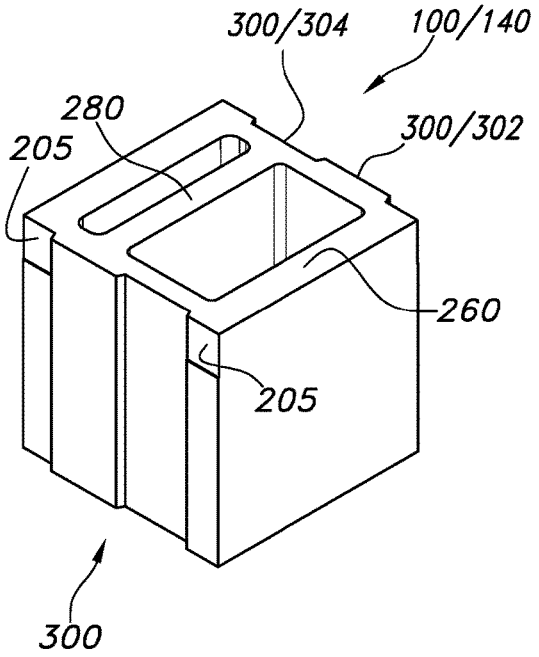
FIG. 5 is a perspective view of the half block according to the invention.
Figure 6:
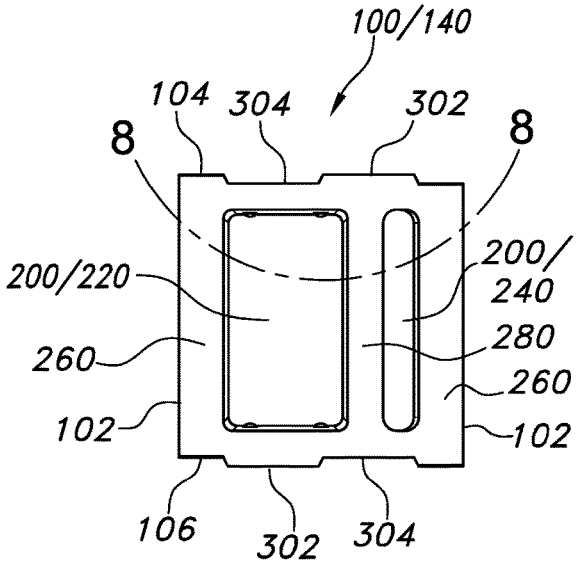
FIG. 6 is a top view of the half block.
Figure 8:
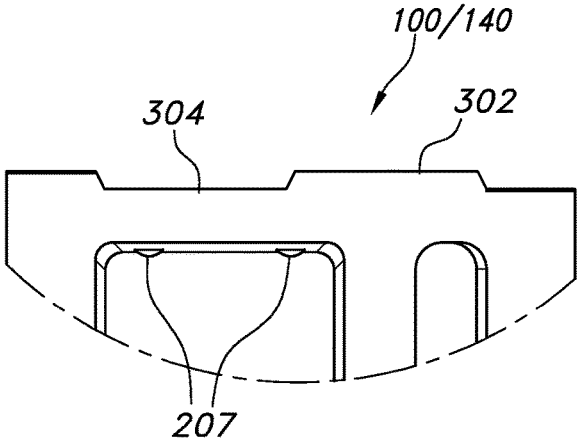
FIG. 8 is an enlarged top view of a partial top view of the half block.
Figure 7:
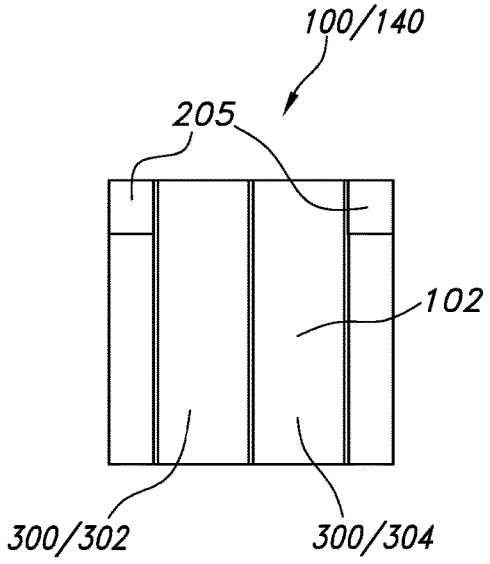
FIG. 7 is a front end view of the half block.

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

The invention is a masonry block 100 for building masonry block walls. The masonry block 100 is constructed to receive insulation materials, reinforcing materials, and utilities. The insulation material may be in any suitable form, for example, a rigid foam block, batting, or spray foam insulation. The utilities include the types of wires, cables and piping that are common in most building structures. The common reinforcing means are reinforcing bars or "rebar".

The term "masonry block" 100 is a general term for the block according to the invention and includes a stretcher block 120 and a half block 140 that fit together to form a wall 160. Incorporated into each block 100 are one or more chambers 200 for receiving insulation and reinforcing bars ("rebar"), among other things, as well as a connector means 300 for mating adjacent blocks with each other. The general shape of the blocks 100 is rectangular, whereby the generally rectangular outer perimeter has one or more indentations and/or protrusions on one or more of the faces of the particular block. Each block has two wall faces 102 that form opposite sides of the block and are the faces of the block that are visible on the two faces of a wall, and each block has a first end face 104 and a second end face 106, a top face 110, and a bottom face 112. Elements that are functionally identical in the various blocks 120 and 140 retain the same reference designation.

FIGS. 1-4 illustrate the stretcher block 120. The wall faces 102 are mirror-reverse images of each other and, thus, one reference designation shall be used to indicate one or both of the wall faces. The connector means 300 on the stretcher block includes a male connector 302 and female connector 304 on each end face 104, 106. When two stretcher blocks 120 are assembled adjacent to one another on a row, the male connector 302 on the first end face 104 mates with the female connector 304 on the second end face 106 of the adjacent block.

The stretcher block 120 includes a plurality of chambers 200. More particularly, the block 120 includes two large chambers 220 and two narrow chambers 240, the chambers being bounded by an outer web 260 and separated by an inner web 280. The large chambers 220 are ideal for the insertion of insulation, with chamber notches 207 provided inside of the large chambers 220 to help secure insulation inside of the chambers 220, and well as for the insertion for reinforcing means such as rebar. The narrow chambers are particularly well suited for utilities such as electrical wiring. The wall face 102 that is adjacent to the narrow chamber 240 may also be cut away, after which a conventional electrical box, which typically has a depth of 2⅛ inches or 2¼ inches, may be inserted in the narrow chamber 240 in such a manner that the outer edge of the electrical box is flush with an inside wall of a building.

Small notches 205 are provided in the upper corner of each face 104, 106 of the block 100, which allow for the insertion of line pins (not shown). After a course of blocks 100 has been put in place, and/or during the laying of a course of blocks 100, a range line may be hooked to each pin to ensure the wall is kept straight.

The stretcher block 120 may be constructed in any suitable size, however, a block that is roughly eight inches in width, eight inches in height, and sixteen inches in length is particularly useful for constructing a strong wall with insulation and reinforcing supports. In this example, the large chambers 220 may be approximately 6.5 inches in length and 3 inches in width while the narrow chambers 240 may be approximately 6.5 inches in length and 1 inch in width. This size of block is also particularly suitable for use with other conventional building materials such as conventional siding and insulation.

FIGS. 5-8 illustrate the half block 140. This block is often used as an end block, in place of the full-size stretcher block 120, so that the blocks 100 may be laid on bond relative to the previously laid course of blocks 100. The construction of this half block 140 is very similar to that of the stretcher block 120, in that it has the wall faces 102, 104, recesses 220 and connectors. The difference being that it has two chambers rather than four, and is roughly half as long as the stretcher block. As with the other blocks, the chambers 220, 240, are open passages through the block 140.

The stretcher block 120 and the half block 140 are each precision ground, meaning that the top face 110 of each block 120, 140, is ground to precise dimensions so that the height of each block 120, 140, in a set of blocks is the same. For example, a set of stretcher blocks 120 that are to be used for a given building may be ground to the precise height of 8 inches, with a length of 16 inches and a depth of 8 inches, while a set of half blocks 140 may also be ground to a precise height of 8 inches, a length of 8 inches, and a depth of 8 inches.

Ensuring that the blocks 100 have the same height and the same depth, in addition to the connection means 300, allows for easy construction compared to the conventional blocks because a wall may be constructed using conventional masonry adhesive rather than mortar, which is a significantly faster and easier method of adhering one row of blocks to another.

More specifically, the method of constructing a wall using the precision ground block includes the following: 1) leveling the ground where the wall is to be constructed; 2) laying a length of wall, with the connection means 300 interlocking between each adjacent block; 3) laying a line of masonry adhesive along the top face 110 of each block in the line; 4) inserting line pins into the notches 205; 5) running a line through the line pins and checking to see that the line of blocks is straight; 6) repeating the process for each layer of blocks until the desired wall height is achieved. As previously mentioned, it is a good practice to use horizontally laid rebar at various spots along the wall. To do this, a notch is ground into the top face 110 of each block in the layer, often along the inner web 280, the rebar is put in place in the notch and then covered by grout to seal it in. Precast concrete lintels may be incorporated as desired to provide support over openings such as doors and windows. Using the blocks 100 with this method allows, for example, for the construction of a block shed that is approximately 10 feet in length, 8 feet in width and 8 feet in height a single day of work to construct using only two masonry workers. Of course, the blocks are also suitable for use with other structures, but in any case they may be laid and assembled in a safe and reliable manner in significantly less time than with conventional blocks.

Figure 9:
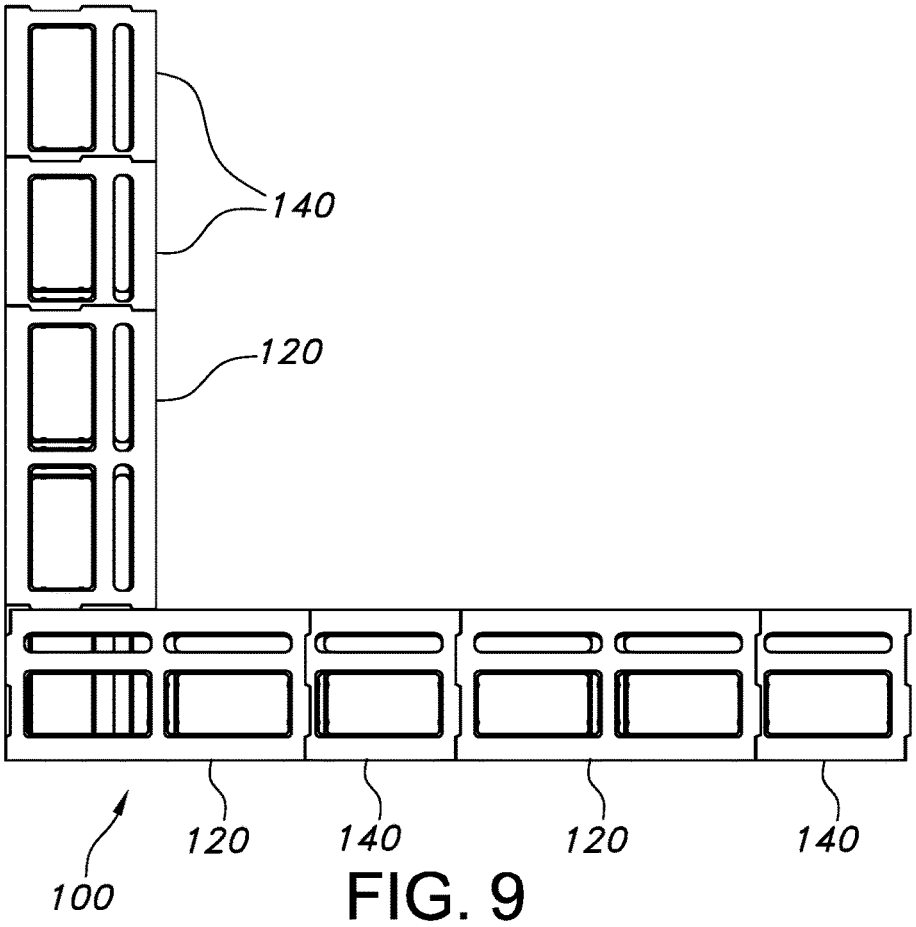
FIG. 9 is a top view of a wall constructed of the blocks.
Figure 10:
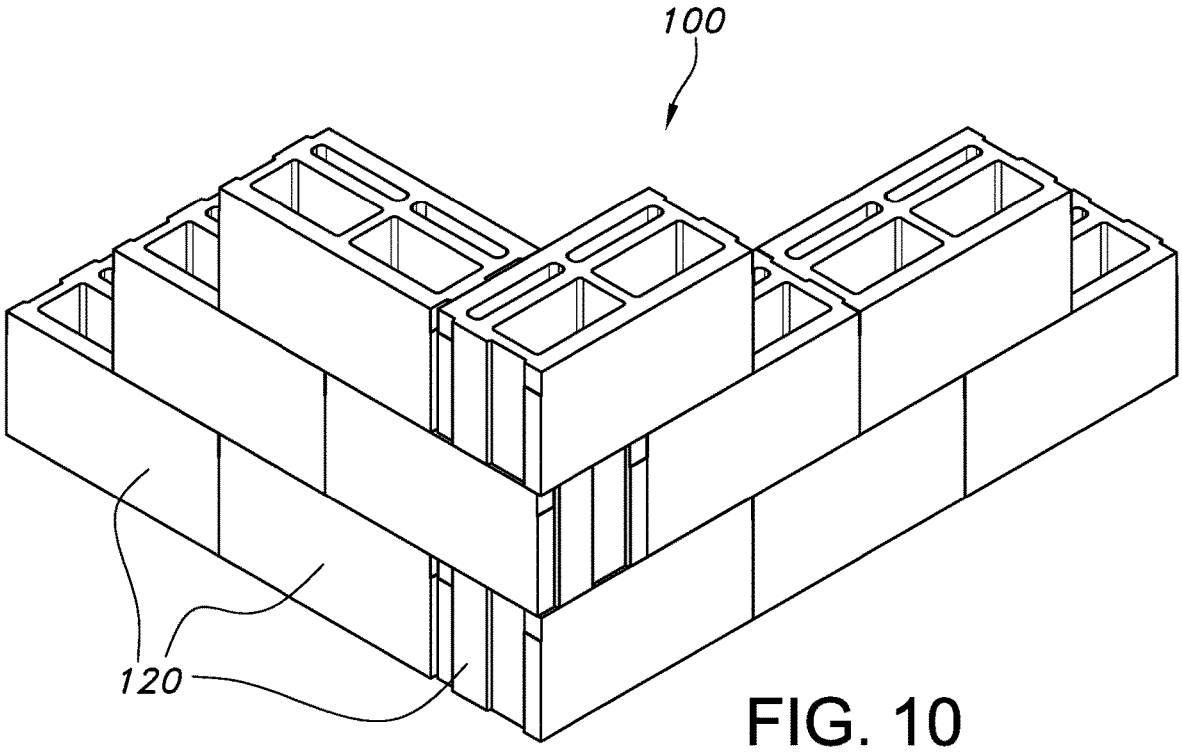
FIG. 10 is a perspective view of a partial wall constructed from the blocks.

FIGS. 9 and 10 illustrate a course of a wall constructed with the building blocks 100 according to the invention. Stretcher blocks 120 and/or half blocks 140 are interconnected with each other. In the embodiment shown, the wall includes a first wall and a second wall that extends at a 90-degree angle to the first wall. It is preferable if vertical rebar is placed every four feet and horizontal rebar is similarly placed every four feet.

It is understood that the embodiments described herein are merely illustrative of the present invention. Variations in the construction of the masonry block system may be contemplated by one skilled in the art without limiting the intended scope of the invention herein disclosed and as defined by the following claims.

What is claimed is:

1. A masonry block adapted to mate with adjacent blocks to form a wall, the masonry block comprising:

a block that is substantially rectangular having four sides, the four sides of the block including two wall faces that are faces of the block that are visible when a wall is constructed, a first end face having a first connector and second connector, a second end face having a first connector and a second connector, and a top face and a bottom face that have openings;

each of the first connectors comprising a first protrusion and a first indentation, each of the first protrusion and the first indentation having a substantially rectangular shape and that extend from approximately the top face to approximately the bottom face, the first protrusion having width that is greater than a width of the first indentation;

each of the second connectors comprising a second protrusion and a second indentation, each of the second protrusion and second indentation having a substantially rectangular shape and that extend from approximately the top face to approximately the bottom face, the second protrusion having width that is less than a width of the second indentation;

the first protrusion contiguous with the second indentation on each end face, the first connector and the second connector on the first end face configured as a mirror image of the first connector and the second connector on the second end face such that the first connector is adapted to mate with the second connector of one of the adjacent blocks and the second connector adapted to mate with the first connector of the adjacent block;

a plurality of chambers within the block that are bounded by the four sides of the block and separated by an inner web;

the plurality of chambers including at least two narrow chambers and two large chambers, each of the two narrow chambers located on one side of the block and bound on one side by one of the two wall faces, and the at least two large chambers located on a side of the block opposite from the narrow chambers and bound by one of the two wall faces.

2. The masonry block of claim 1, wherein each of the at least two narrow chambers and at least two large chambers are substantially rectangular.

3. The masonry block of claim 2 further comprising a notch in an upper corner of each end face.

4. The masonry block of claim 3 further comprising one or more chamber notches located inside one or more of the chambers.

5. The masonry block of claim 1, wherein the plurality of chambers includes two chambers, each of the two chambers being substantially rectangular.

6. The masonry block of claim 5 further comprising a notch in an upper corner of each end face.

7. The masonry block of claim 6 further comprising one or more chamber notches located inside one or more of the chambers.

8. The masonry block of claim 1, wherein the top face and bottom face are parallel to one another and a height of the block between the top face and bottom face configured to be a precise predetermined height.

* * * * *